US011488762B2

(12) United States Patent
Ryu et al.

(10) Patent No.: US 11,488,762 B2
(45) Date of Patent: Nov. 1, 2022

(54) CHIP INDUCTOR AND METHOD OF MANUFACTURING THE SAME

(71) Applicant: SAMSUNG ELECTRO-MECHANICS CO., LTD., Suwon-si (KR)

(72) Inventors: Joung Gul Ryu, Suwon-si (KR); Mi Geum Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 634 days.

(21) Appl. No.: 16/298,437

(22) Filed: Mar. 11, 2019

(65) Prior Publication Data

US 2020/0027644 A1 Jan. 23, 2020

(30) Foreign Application Priority Data

Jul. 19, 2018 (KR) ..... 10-2018-0083974

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/292* (2013.01); *H01F 27/323* (2013.01);
(Continued)

(58) Field of Classification Search
USPC ..... 336/200
See application file for complete search history.

(56) References Cited

U.S. PATENT DOCUMENTS

2009/0145766 A1* 6/2009 Takai ..... H05K 3/28 205/112
2014/0145812 A1* 5/2014 Lee ..... H01F 41/041 336/200
(Continued)

FOREIGN PATENT DOCUMENTS

CN 104078221 A 10/2014
CN 106158242 A 11/2016
(Continued)

OTHER PUBLICATIONS

English translation of JP2006310716 (Year: 2006).*
(Continued)

*Primary Examiner* — Ronald Hinson
(74) *Attorney, Agent, or Firm* — Morgan, Lewis & Bockius LLP

(57) ABSTRACT

A chip inductor includes a body having a coil and an insulating member on which the coil is disposed, and external electrodes disposed on external surfaces of the body. The insulating layers are disposed on one surface of the insulating member in the body and another surface opposing the one surface, respectively, and are made of a material different from a material of the insulating member. The insulating member and the insulating layers constitute a multilayer structure. The coil includes a top coil and a bottom coil disposed on a top surface and a bottom surface of the multilayer structure, respectively. The top and bottom coils are connected by a via penetrating through the top and bottom surfaces of the multilayer structure.

22 Claims, 5 Drawing Sheets

(51) Int. Cl.
*H01F 27/29* (2006.01)
*H01F 41/04* (2006.01)
*H01F 27/32* (2006.01)

(52) U.S. Cl.
CPC ..... *H01F 27/327* (2013.01); *H01F 41/041* (2013.01); *H01F 2027/2809* (2013.01)

(56) References Cited

U.S. PATENT DOCUMENTS

| | | | | |
|---|---|---|---|---|
| 2014/0285305 | A1 | 9/2014 | Yoo et al. | |
| 2014/0354396 | A1 | 12/2014 | Nukaga et al. | |
| 2015/0035634 | A1* | 2/2015 | Nakamura | H01F 41/046 336/170 |
| 2015/0097647 | A1* | 4/2015 | Lee | H01F 17/0013 336/192 |
| 2015/0270053 | A1* | 9/2015 | Cha | H01F 27/292 336/192 |
| 2016/0078998 | A1* | 3/2016 | Park | H01F 17/0013 336/200 |
| 2016/0293320 | A1* | 10/2016 | Kim | H01F 17/0013 |
| 2016/0336105 | A1 | 11/2016 | Choi et al. | |
| 2017/0037223 | A1 | 2/2017 | Charrak et al. | |
| 2017/0194084 | A1 | 7/2017 | Choi et al. | |
| 2018/0019050 | A1 | 1/2018 | Min | |
| 2018/0061555 | A1 | 3/2018 | Jang et al. | |
| 2018/0197672 | A1 | 7/2018 | Kim et al. | |

FOREIGN PATENT DOCUMENTS

| | | | |
|---|---|---|---|
| CN | 107039155 | A | 8/2017 |
| CN | 108109788 | A | 6/2018 |
| CN | 108281261 | A | 7/2018 |
| JP | 2001-203109 | A | 7/2001 |
| JP | 2015-032625 | A | 2/2015 |
| KR | 10-1999-0066108 | A | 8/1999 |
| KR | 10-2014-0066437 | A | 6/2014 |
| KR | 10-2016-0148584 | A | 12/2016 |
| KR | 10-1701063 | B1 | 1/2017 |
| KR | 10-2018-0007874 | A | 1/2018 |
| KR | 10-2018-0025113 | A | 3/2018 |

OTHER PUBLICATIONS

Korean Office Action dated Sep. 2, 2019 issued in Korean Patent Application No. 10-2018-0083974 (with English translation).
Chinese Office Action dated Jan. 4, 2022, issued in corresponding Chinese Patent Application No. 201910520421.X.

* cited by examiner

CHIP INDUCTOR AND METHOD OF MANUFACTURING THE SAME

CROSS-REFERENCE TO RELATED APPLICATION(S)

This application claims the benefit of priority to Korean Patent Application No. 10-2018-0083974 filed on Jul. 19, 2018 in the Korean Intellectual Property Office, the disclosure of which is incorporated herein by reference in its entirety.

TECHNICAL FIELD

The present disclosure relates to a chip inductor and a method of manufacturing the same, and more particularly, to a thin-film chip inductor and a method of manufacturing the same.

BACKGROUND

As the miniaturization and thinning of various electronic devices have accelerated with the development of information technology (IT), thin-film inductors have also been required to be miniaturized and thinned. In the case of a power inductor, a chip size has decreased, but an increase in the number of turns of a coil pattern (fine patterning), a development of high-permeability materials, and a technique to increase a pattern height are required to achieve miniaturization of products without the loss of chip characteristics such as inductance, Rdc, and the like.

SUMMARY

An aspect of the present disclosure is to provide a chip inductor which prevents damage to an insulating member included in the chip inductor.

According to an aspect of the present disclosure, a chip inductor includes a body having a coil and an insulating member on which the coil is disposed, and external electrodes disposed on external surfaces of the body. The insulating layers are disposed on one surface of the insulating member in the body and another surface opposing the one surface, respectively, and are made of a material different from a material of the insulating member. The insulating member and the insulating layers constitute a multilayer structure. The coil includes a top coil and a bottom coil disposed on a top surface and a bottom surface of the multilayer structure, respectively. The top and bottom coils are connected by a via penetrating through the top and bottom surfaces of the multilayer structure.

The insulating layers may be made of an epoxy-novolac-based resin having a hydroxyl group.

Entire surfaces of the insulating member may be covered with the insulating layers.

The coil may include a plurality of conductive layers, which includes a first conductive layer disposed on the insulating layers.

Among the plurality of conductive layers, the first conductive layer brought into contact with the insulating layers may include at least one of nickel (Ni), niobium (Nb), molybdenum (Mo), and palladium (Pd).

Among the plurality of conductive layers, the first conductive layer brought into contact with the insulating layers may be a copper (Cu) plating layer.

The plurality of conductive layers may further include a second conductive layer, disposed on the first conductive layer, having a thickness greater than a thickness of the first conductive layer.

A filler may be impregnated in the insulating member.

A glass fabric may be included in the insulating member.

The insulating member may have a thickness ranging from 15 micrometers to 40 micrometers.

The insulating member may include a polyimide material.

Each of the insulating layers may have a thickness ranging from 1 μm to 25 μm.

A through-hole may be disposed on the multilayer structure, spaced apart from the via, and filled with the encapsulant.

According to an aspect of the present disclosure, a method of manufacturing a chip inductor includes preparing a multilayer structure including an insulating member and insulating layers attached to one surface and another surface of the insulating member, respectively, providing metal layers, each having a predetermined thickness, on top and bottom surfaces of the multilayer structure, respectively, exposing the multilayer structure by patterning the metal layers in such a manner that the metal layer has a plurality of openings, processing a via hole penetrating through the multilayer structure, forming top and bottom coils on exposed surfaces of the multilayer structure, dicing the multilayer structure to be divided in the form of individual chips, insulating surfaces of the top and bottom coils, and forming a body encapsulating the top and bottom coils and forming external electrodes on external surfaces of the body. The exposing the multilayer structure includes an etching process.

The method may include performing a desmearing process after processing the via hole.

The desmearing process may use a $CO_2$ laser.

The insulating member and the insulating layers in the multilayer structure may include different materials from each other.

The insulating layer may be made of an epoxy-novolac-based resin having a hydroxyl group.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
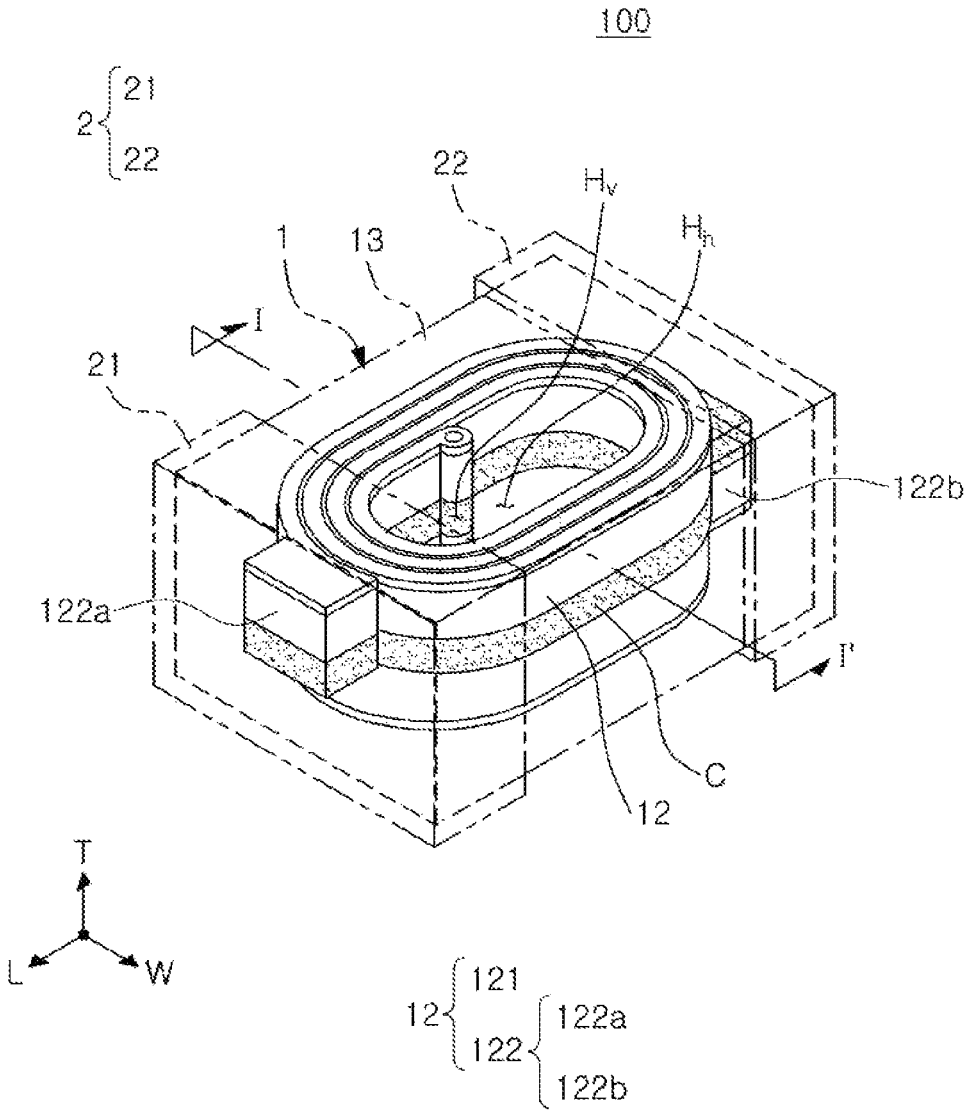
FIG. 1 is a perspective view of a chip inductor according to an example.

Hereinafter, examples of the present disclosure will be described as follows with reference to the attached drawings.

The present disclosure may, however, be embodied in many different forms and should not be construed as being limited to the examples set forth herein. Rather, these examples are provided so that this disclosure will be thorough and complete, and will fully convey the scope of the present disclosure to those skilled in the art.

The same reference numerals are used to designate the same elements throughout the drawings. In the drawings, the sizes and relative sizes of layers and regions may be exaggerated for clarity.

It will be understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Hereinafter, a chip inductor according to an example and a method of manufacturing the same will be described, but is not limited thereto.

Chip Inductor

Figure 2:
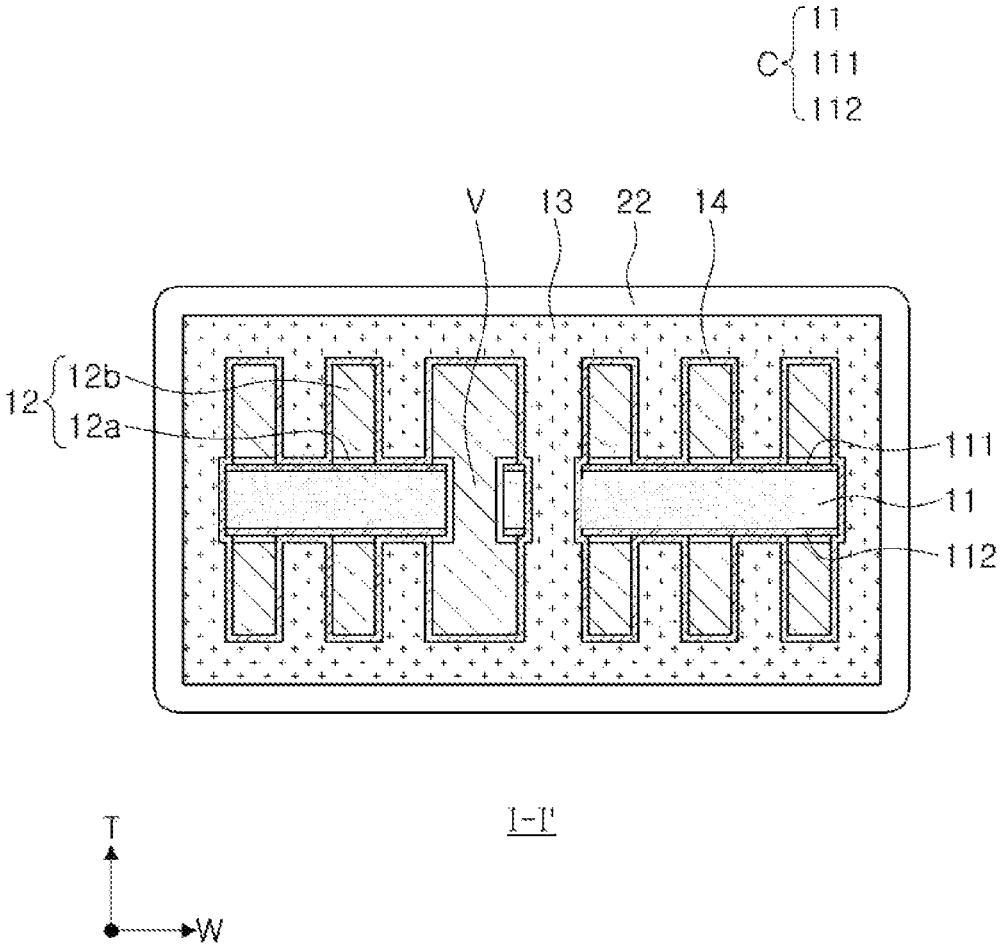
FIG. 2 is a cross-sectional view taken along line I-I' in FIG. 1.

FIG. 1 is a perspective view of a chip inductor according to an example, and FIG. 2 is a cross-sectional view taken along line I-I' in FIG. 1.

Referring to FIGS. 1 and 2, a chip inductor 100 includes a body 1 and an external electrode 2 disposed on external surfaces of the body 1.

The external electrode 2 includes a first external electrode 21 and a second external electrode 22 disposed on the external surfaces of the body 1 to oppose each other in a length direction L. Although the external electrode 2 has a shape extending from one surface of the body 1 to four adjacent surfaces thereof, the shape of the external electrode 2 is not limited thereto and may be modified into various shapes as needed by those skilled in the art. For example, the external electrode 2 may have an 'L' shape or an 'I' shape. Since the external electrode 2 is connected to a lead portion of an internal coil, the external electrode 2 should include a material having improved electrical conductivity.

The body 1 has a first end surface and a second end surface disposed to oppose each other in the length direction L, a first side surface and a second side surface disposed to oppose each other in a width direction W, and has a substantially hexahedral shape having a top surface and a bottom surface disposed to oppose each other in a thickness direction T.

An insulating member 11, having a through-hole Hh and a via hole Hv, is included in the body 1. The insulating member 11 serves to mechanically support the coil 12 disposed thereon and to facilitate the formation of a coil.

Insulating layers 111 and 112 are respectively disposed on one surface and the other surface of the insulating member 11 opposing the one surface.

The insulating member 11 and the insulating layers 111 and 112 constitute a multilayer structure C laminated in the thickness direction T of the body 1.

The multilayer structure C has a via hole Hv, passing through top and bottom surfaces of the multilayer structure C, and a through-hole Hh spaced apart from the via hole Hv.

The via hole Hv is filled with a conductive material in such a manner that a via V is formed to connect a top coil and a bottom coil to each other.

The insulating member 11 and the insulating layers 111 and 112 in the multilayer structure C are formed of different materials from each other to have different physical properties.

The insulating member 11 includes a material, having an insulating property, and may be, for example, a resin layer of a thin film made of a polyimide material. The insulating member 11 may be a magnetic insulator having a magnetic property as well as the insulating property. For example, the insulating member 11 may have a structure in which a filler is impregnated in a resin. The filler refers to particles added to reinforce a bending property or mechanical rigidity of the insulating member 11, and a type or a content of the filler may be appropriately selected depending on characteristics of the insulating member 11. The insulating member 11 may include a resin and a glass fabric impregnated with the resin, and may be an Ajinomoto build-up film (ABF), a PID resin, or the like. A thickness of the insulating member 11 is more advantageous as the insulating member 11 becomes thinner. For example, the insulating member 11 has a thickness, in detail, ranging from 10 micrometers (μm) to 60 μm and, in further detail, ranging from 15 μm to 40 μm, to support a coil and stably maintain a coil shape when a coil is formed. When the insulating member has a thickness less than 10 μm, a coil may not be supported properly or a rolling phenomenon may occur during a process of forming the coil. When the insulating member 11 has a thickness greater than 60 μm, it is difficult to sufficiently increase a thickness of a coil, on the basis of a limited chip thickness of a coil component. In further detail, the insulating member 11 may have a thickness ranging from 10 μm to 35 μm. In this case, the coil may be stably supported, while implementing a desired thickness of the coil. Thus, the rolling phenomenon may be significantly reduced during formation of the coil.

The insulating layers 111 and 112, disposed on one surface and the other surface of the insulating member 11, respectively, have a structure covering the entirety of the one surface and the other surface. In this case, the one surface and the other surface of the insulating member 11 are not exposed outwardly and are protected by an insulating layer.

The insulating layer 111 or 112 has a thickness, in detail, ranging from 1 μm to 25 μm. When the insulating layer 111 or 112 has a thickness less than 1 μm, possibility of damaging the insulating layer 111 or 112 during a desmearing process, described later, is significantly increased. When the insulating layer 111 or 112 has a thickness greater than 25 μm, it may be difficult to apply the configuration, in which insulating layers 111 and 112 are disposed on the one surface and the other surface of the insulating member 11, to an existing facility equipment.

The insulating layers 111 and 112 are made of a material different from a material of the insulating member 11. In detail, the insulating layers 111 and 112 include an epoxy-novolac-based resin having a hydroxyl group. The insulating layers 111 and 112 serve to protect the insulating member 11. Specifically, the insulating member 11 is thinned with a low profile tendency to decrease a thickness of a chip inductor. As the insulating member 11 is thinned, when a via hole is formed to penetrate through the insulating member 11, a portion of an insulating material remains around the via hole and is injected into the processed via hole or the insulating member 11 is severely eroded by an etchant during an etching step in a desmearing process, after processing the via hole, to frequently damage the insulating member 11. The insulating layers 111 and 112 may be protective layers covering the one surface and the other surface of the insulating member 11 to prevent the above issue. The insulating layers 111 and 112 are protective layers preventing exposure of a filler, erosion of a remaining resin, or exposure of a glass fabric in the insulating member 11 during an etching step in the desmearing process after processing the via hole. In addition, since the insulating layers 111 and 112 are appropriate to directly perform chemical copper plating on the insulating layers 111 and 112, it is unnecessary to introduce an expensive sputtering process on the insulating layers 111 and 112. Thus, mass productivity of the chip inductor may be improved.

Since the insulating layers 111 and 112 are made of a material pyrolyzed at about 370 degrees Celsius, heat resistant characteristics may be improved in a press process, a stacking process, a lamination process, or the like, compared with a case in which a coil is directly formed on an insulating member.

In addition, since the insulation layers 111 and 112 are made of a material having improved adhesion to copper (Cu) constituting a coil, delamination of the coil may be prevented to improve reliability of the chip inductor. In this regard, the insulating layers 111 and 112 include an epoxy-novolac-based resin having a hydroxyl group. When a desmearing process is performed to fabricate a chip inductor, a polar group generated through a desmear reaction mechanism are increased to improve adsorption to palladium (Pd). Thus, affinity with the chemical copper plating may be enhanced. A known copper clad laminate (CCL), used as a support member of a chip inductor, means that adhesion is improved when a chemical copper plating is performed thereon.

Apart from the via hole Hv passing through top and bottom surfaces of the multilayer structure C, a through-hole Hh is formed at a position spaced apart from the via hole Hv. The through-hole Hh is filled with an encapsulant 13 described later. A permeability of a coil component is increased by the encapsulant filling the through-hole Hh.

A coil 12 includes a coil body 121 wound a plurality of times and a lead portion 122 connected to both ends of the coil body 121. The lead portion 122 includes a first lead portion 122*a* connected to a first external electrode 21 and a second lead portion 122*b* connected to a second external electrode 22.

The coil 12 includes a plurality of conductive layers. The plurality of conductive layers include a first conductive layer 12*a* disposed at a lowermost portion to be in contact with the insulating layers 111 and 112. The first conductive layer 12*a* may be a copper (Cu) plating layer or a layer containing at least one of nickel (Ni), niobium (Nb), molybdenum (Mo), and palladium (Pd).

In the case in which the first conductive layer 12*a* is a copper (Cu) plating layer, the top and bottom surfaces of the multilayer structure C include insulating layers, as described above. Therefore, although a Cu plating layer is directly formed on the insulating layer using a semi-additive process (SAP), delamination of the Cu plating layer may be prevented. In the case in which the first conductive layer 12*a* includes a Cu plating layer, manufacturing yield and reliability for manufacturing the chip inductor may be improved.

A case in which the first conductive layer 12*a* includes at least one of Ni, Nb, Mo, and Pd is a case in which a seed layer is formed on the insulating layer using a sputtering method. Since the first conductive layer 12*a* is disposed at a lowermost portion of the coil, the first conductive layer 12*a* substantially serves as a seed layer for a second conductive layer 12*b* disposed thereon and having a thickness greater than a thickness of the first conductive layer 12*a*. When the first conductive layer 12*a* is formed by applying a sputtering process, a thinner and more uniform seed layer may be implemented.

Method of Manufacturing Chip Inductor

FIGS. 3A to 3H illustrate a method of manufacturing a chip inductor 100 according to another example. It is a matter of course that a manufacturing method described below is merely an exemplary method, and the inductor 100 may be manufactured by other manufacturing methods which are not described in the present disclosure.

Figure 3A:
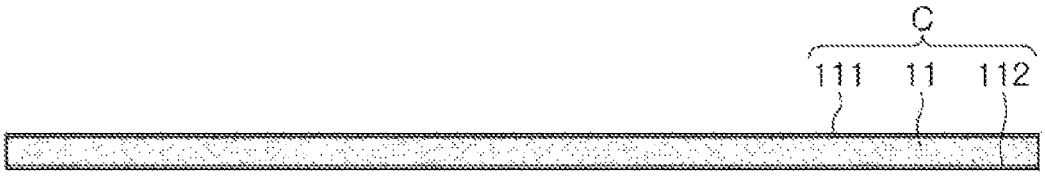
FIGS. 3A to 3H illustrate a method of manufacturing a chip inductor according to another example.

Referring to FIG. 3A, a multilayer structure C is prepared. The multilayer structure C includes an insulating member 11 and insulating layers 111 and 112 attached to one surface and the other surface of the insulating member 11, respectively. As described above with reference to FIGS. 1 and 2, the insulating member 11 and the insulating layers 111 and 112 include different materials from each other.

Figure 3B:
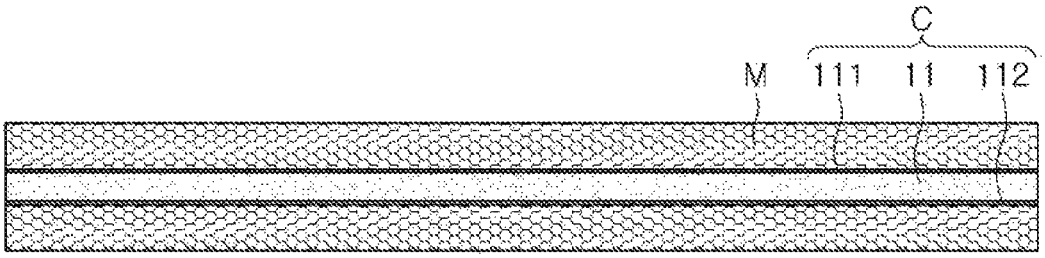

Referring to FIG. 3B, a metal layer M having a predetermined thickness is disposed on the laminated structure C. The total thickness of the laminated structure (C) and the metal layer M is about 60 μm, and a related-art apparatus may be used as it is. For example, when the multilayer structure has a thickness of 20 μm of a thin film, each of the insulating layers 111 and 112 disposed on one surface and the other surface have a thickness of 20 μm in such a manner that the multilayer structure may be easily applied to the related-art apparatus.

Figure 3C:
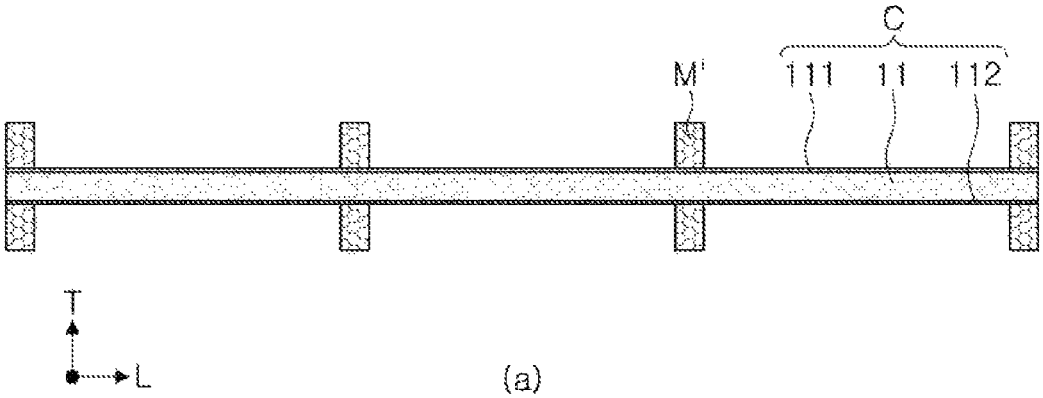
Figure 3C:
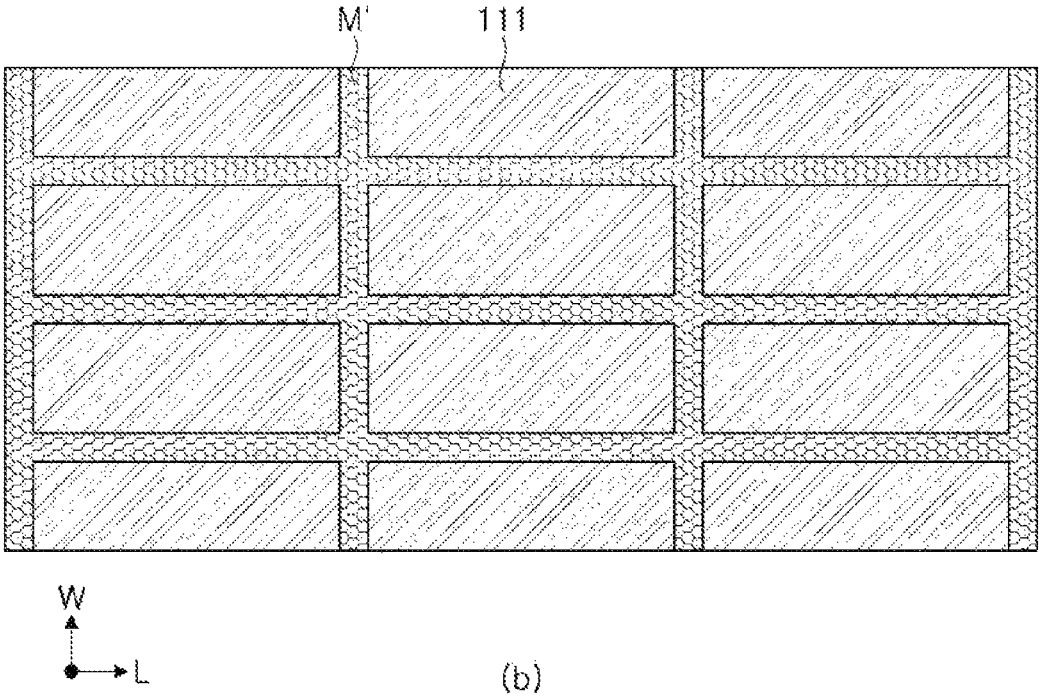

Referring to FIG. 3C, the metal layer M is patterned using a patterned dry film resist (DFR). The patterned metal layer M' is removed using a dicing process and is not shown in an ultimate chip inductor. The patterned metal layer M' is disposed on the multilayer structure C in such a manner that an existing apparatus may be used as it is, and an insulating member and an insulating layer in a thinned multilayer structure are not bent or rolled during a process. The patterned metal layer M' is exposed to top and bottom surfaces of the multilayer structure C. In FIG. 3C, (a) shows an L-T cross section and (b) shows an L-W cross section. As can be seen from (b) in FIG. 3C, the patterned metal layer M' is formed to have a lattice shape.

Figure 3D:
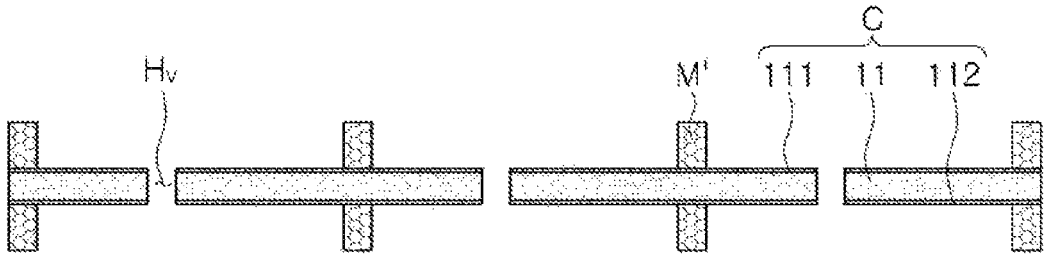

Referring to FIG. 3D, a via hole Hv is formed to penetrate the top and bottom surfaces of the multilayer structure C. The via hole Hv may have any shape as long as it penetrates the top and bottom surfaces of the multilayer structure C. For example, the via hole Hv may have a cylindrical shape and may have a tapered cross-sectional shape in such a manner that a diameter is smallest in the center of the multilayer structure C. After the via hole Hv is formed, a desmearing process is performed. The desmearing process is a process of removing remaining smears which are resin residues produced by formation of via holes or the like. The remaining smears are removed to prevent an open defect and to improve a surface quality of an insulation layer for formation of a coil. A detailed manner of the desmearing process is not limited, but a $CO_2$ laser may be directly applied to the insulating layer. In this case, even when the $CO_2$ laser is directly applied to the insulating layer, the insulating layer disposed on the insulating member serves as a protective layer of the insulating member to prevent a defective surface state of the multilayer structure C and a surface morphology defect around the via hole Hv. A material of the insulating layer is, in detail, an epoxy-novolac-based resin having an epoxy group in the ultimate chip inductor. Such a material may be explained as a material whose adsorption to palladium (Pd) ions is improved as polar groups generated by a reaction mechanism of the desmearing process increase, although there is no —OH group in an insulating layer itself, prepared as a multilayer structure.

Figure 3E:
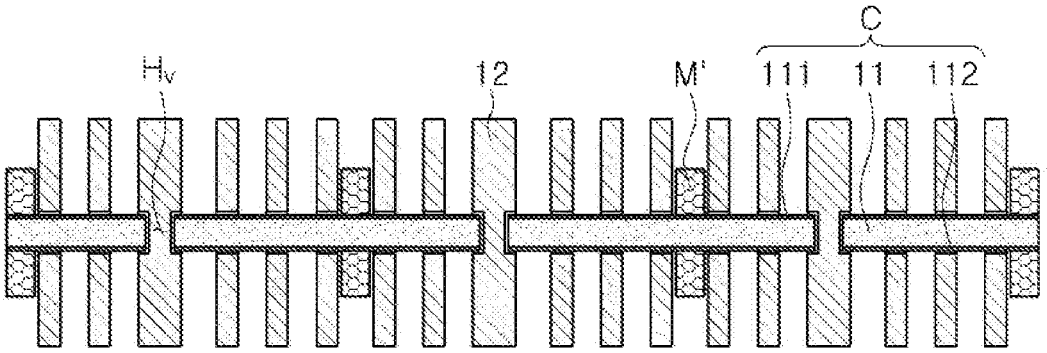

Referring to FIG. 3E, a coil 12 is formed on the multilayer structure C. The coil 12 includes a top coil and a bottom coil disposed on the top surface of the multilayer structure C.

The top and bottom coils may be formed by any method, and, among the plurality of conductive layers, a first conductive layer 12*a* brought into direct contact with the multilayer structure may be formed using a sputtering method or a chemical copper plating method. Although the first conductive layer 12*a* is formed using the chemical copper plating method, adhesion between the insulating layer and a chemical copper plating layer is greater than adhesion between the insulating member and the chemical copper plating layer. Therefore, delamination of the first conductive layer 12*a* may be prevented. A second conductive layer 12*b* is formed on the first conductive layer 12*a* to substantially determine a thickness of the coil, and a manner of forming the second conductive layer 12*b* is not limited. The second conductive layer 12*b* may be formed by anisotropic plating using the first conductive layer 12*a* as a seed layer. Alternatively, the second conductive layer 12*b* may be formed by laminating an insulating material to fill the first conductive layer 12*a*, patterning the insulating material, and filling an opening of the pattern insulating material with the first conductive layer 12*a*.

Figure 3F:
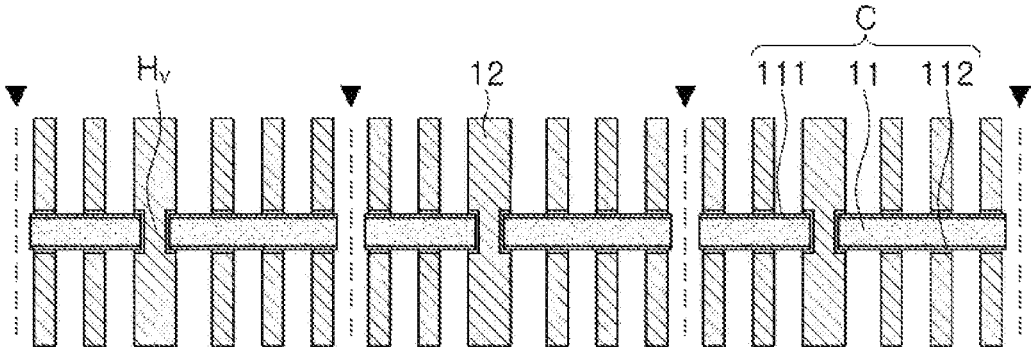

FIG. 3F illustrates a dicing process. The dicing process is not limited, and is performed by those skilled in the art using an appropriate blade in the form of individual chips. The individual chips may be distinguished on the basis of a patterned metal layer M' prepared through the process in FIG. 3C. The metal layer M' is not included in the chips individualized through the dicing process.

Figure 3G:
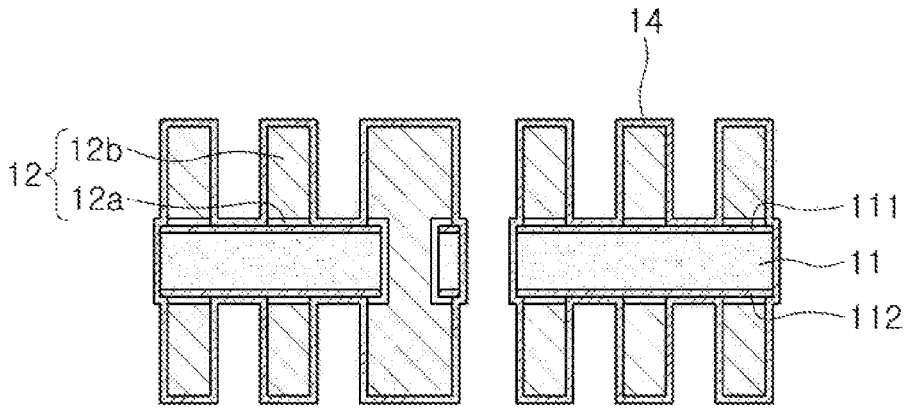

Referring to FIG. 3G, an insulating layer 14 is disposed on a coil surface in the individual chip to insulate the coil 12 from a magnetic material in an encapsulant described later. A manner of forming the insulating layer 14 may be appropriately selected from chemical vapor deposition (CVD), sputtering, dipping, an insulating sheet lamination process, and the like by those skilled in the art.

Figure 3H:
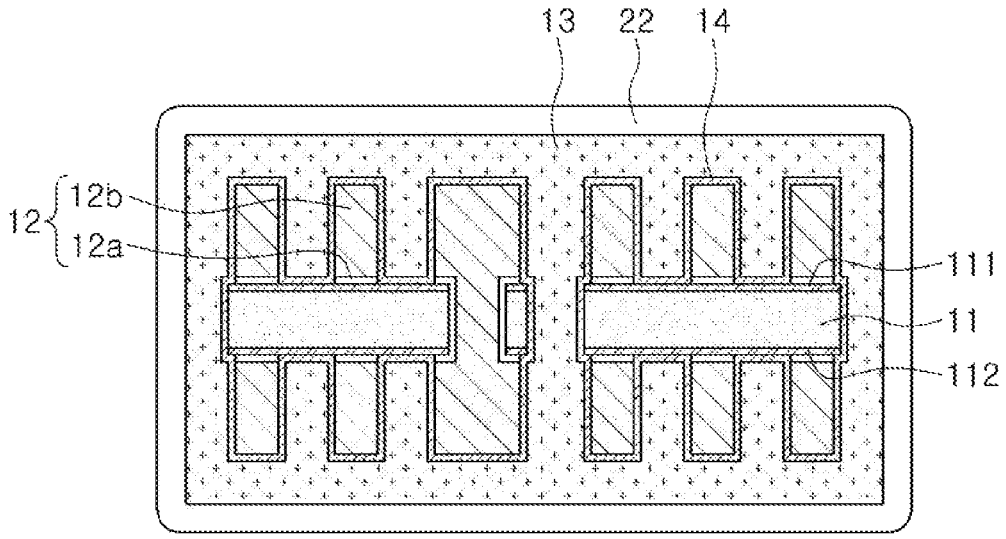

FIG. 3H illustrates a final process of forming a chip inductor. During the process, an encapsulant 13 is filled and an external electrode 2 for connection to the coil 12 is formed on an external surface of the encapsulant 13.

According to an example, one of various effects of the present disclosure is prevent an open defect or the like of a chip inductor. As a result, reliability of the chip inductor is improved.

While examples have been shown and described above, it will be apparent to those skilled in the art that modifications and variations could be made without departing from the scope of the present invention as defined by the appended claims.

What is claimed is:

1. A chip inductor comprising:

a body having a coil and an insulating member on which the coil is disposed; and external electrodes disposed on external surfaces of the body, wherein first and second insulating layers are disposed on one surface of the insulating member in the body and another surface opposing the one surface, respectively, and are made of a material different from a material of the insulating member, the insulating member and the first and second insulating layers constitute a multilayer structure, the coil includes a top coil and a bottom coil disposed on a top surface and a bottom surface of the multilayer structure, respectively, the top and bottom coils are connected by a via penetrating through the top and bottom surfaces of the multilayer structure, the top coil includes a first conductive layer in contact with the first insulating layer, and a second conducive layer directly disposed on the first conductive layer and having a thickness greater than a thickness of the first conductive layer, the second conductive layer is spaced apart from the first insulating layer, and a third insulating layer covers and is in contact with side surfaces of the insulating member, the first and second insulating layers, and the first and second conductive layers.

2. The chip inductor of claim 1, wherein the first and second insulating layers are made of an epoxy-novolac-based resin having a hydroxyl group.

3. The chip inductor of claim 1, wherein entire upper and lower surfaces of the insulating member are covered with the first and second insulating layers, respectively.

4. The chip inductor of claim 1, wherein the bottom coil includes a third conductive layer in contact with the second insulating layer, and a fourth conducive layer directly disposed on the third conductive layer and having a thickness greater than a thickness of the third conductive layer, and the fourth conductive layer is spaced apart from the second insulating layer.

5. The chip inductor of claim 1, wherein the first conductive layer includes at least one of nickel (Ni), niobium (Nb), molybdenum (Mo), and palladium (Pd).

6. The chip inductor of claim 1, wherein the first conductive layer is a copper (Cu) plating layer.

7. The chip inductor of claim 1, wherein a filler is impregnated in the insulating member.

8. The chip inductor of claim 1, wherein a glass fabric is included in the insulating member.

9. The chip inductor of claim 1, wherein the insulating member has a thickness ranging from 15 micrometers to 40 micrometers.

10. The chip inductor of claim 1, wherein the insulating member includes a polyimide material.

11. The chip inductor of claim 1, wherein each of the first and second insulating layers has a thickness ranging from 1 μm to 25 μm.

12. The chip inductor of claim 1, wherein a through-hole is disposed on the multilayer structure, spaced apart from the via, and filled with the encapsulant.

13. The chip inductor of claim 1, wherein the body includes an encapsulant with a magnetic material to embedded the coil and the insulating member, and in a region between adjacent turns of the coil, the third insulating layer is disposed between the first insulating layer and the encapsulant and between the second insulating layer and the encapsulant.

14. A chip inductor comprising:

a body having a coil and an insulating member on which the coil is disposed; and external electrodes disposed on external surfaces of the body, wherein first and second insulating layers are disposed on one surface of the insulating member in the body and another surface opposing the one surface, respectively, and are made of a material different from a material of the insulating member, the insulating member and the first and second insulating layers constitute a multilayer structure, the coil includes a top coil and a bottom coil disposed on a top surface and a bottom surface of the multilayer structure, respectively, the top and bottom coils are connected by a via penetrating through the top and bottom surfaces of the multilayer structure, the first and second insulating layers are made of an epoxy-novolac-based resin having a hydroxyl group, and a third insulating layer covers and is in contact with side surfaces of the insulating member and the first and second insulating layers.

15. The chip inductor of claim 14, wherein entire upper and lower surfaces of the insulating member are covered with the first and second insulating layers, respectively.

16. The chip inductor of claim 14, wherein the insulating member has a thickness ranging from 15 micrometers to 40 micrometers.

17. The chip inductor of claim 14, wherein each of the first and second insulating layers has a thickness ranging from 1 μm to 25 μm.

18. The chip inductor of claim 14, wherein the body includes an encapsulant with a magnetic material to embedded the coil and the insulating member, and in a region between adjacent turns of the coil, the third insulating layer is disposed between the first insulating layer and the encapsulant and between the second insulating layer and the encapsulant.

19. The chip inductor of claim 14, wherein the top coil includes a plurality of conductive layers, which includes a first conductive layer disposed on the insulating layers.

20. The chip inductor of claim 19, wherein the first conductive layer in contact with the first insulating layer includes at least one of nickel (Ni), niobium (Nb), molybdenum (Mo), and palladium (Pd).

21. The chip inductor of claim 19, wherein the first conductive layer in contact with the first insulating layer is a copper (Cu) plating layer.

22. The chip inductor of claim 19, wherein the plurality of conductive layers further include a second conductive layer, disposed on the first conductive layer, having a thickness greater than a thickness of the first conductive layer.

* * * * *